US010643554B2

(12) United States Patent
Tari et al.

(10) Patent No.: US 10,643,554 B2
(45) Date of Patent: May 5, 2020

(54) LIQUID CRYSTAL DISPLAY WITH TEMPERATURE COMPENSATION

(71) Applicant: Carrier Corporation, Farmington, CT (US)

(72) Inventors: Joseph A. Tari, Clay, NY (US); Cheryl M. Keiling, Camillus, NY (US); Jamie Creighton, Baldwinsville, NY (US); Jeffrey C. Richards, Baldwinsville, NY (US); Sean Rudd, Canastota, NY (US); Charles Volkmann, Syracuse, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 154 days.

(21) Appl. No.: 15/515,462

(22) PCT Filed: Oct. 1, 2015

(86) PCT No.: PCT/US2015/053520

§ 371 (c)(1),
(2) Date: Mar. 29, 2017

(87) PCT Pub. No.: WO2016/054393

PCT Pub. Date: Apr. 7, 2016

(65) Prior Publication Data

US 2017/0221430 A1 Aug. 3, 2017

Related U.S. Application Data

(60) Provisional application No. 62/058,889, filed on Oct. 2, 2014.

(51) Int. Cl.
*G09G 3/36* (2006.01)

(52) U.S. Cl.
CPC ..... *G09G 3/36* (2013.01); *G09G 3/3611* (2013.01); *G09G 2310/08* (2013.01);
(Continued)

(58) Field of Classification Search
CPC ..... G09G 3/36; G09G 2320/041; G09G 2320/066; G09G 2310/08; G09G 3/3611; G09G 2320/0233
See application file for complete search history.

(56) References Cited

U.S. PATENT DOCUMENTS 4,773,735 A 9/1988 Ukrainsky et al.
5,029,982 A 7/1991 Nash
(Continued)

FOREIGN PATENT DOCUMENTS

CN 103207467 A 7/2013
EP 1443486 A1 8/2004

OTHER PUBLICATIONS

International Search Report and Written Opinion for application PCT/US2015/053520, dated Nov. 19, 2015, 11pgs.
(Continued)

*Primary Examiner* — Abhishek Sarma
(74) *Attorney, Agent, or Firm* — Cantor Colburn LLP

(57) ABSTRACT

A liquid crystal display (LCD) unit and associated method for compensating for the effects of low temperatures. The LCD unit includes a heating panel disposed adjacent to the LCD panel. A temperature sensor measures the temperature of the LCD panel. A controller compares the measured temperature to a threshold temperature and one or more set points and operates the heating panel accordingly. Further, the controller is configured to control one or more contrast parameters in response to the comparison of the measured temperature to the one or more set points.

7 Claims, 3 Drawing Sheets

(52) U.S. Cl.
CPC ..... *G09G 2320/0233* (2013.01); *G09G 2320/041* (2013.01); *G09G 2320/066* (2013.01)

(56) References Cited

U.S. PATENT DOCUMENTS 5,416,495 A 5/1995 Davis et al.
5,744,819 A 4/1998 Yamamoto et al.
5,914,764 A * 6/1999 Henderson ..... G09G 3/18 345/102
6,128,053 A 10/2000 Brandt et al.
6,303,911 B1 10/2001 Welch, Jr.
6,309,099 B1 * 10/2001 Chang ..... G06F 1/206 374/183
6,309,100 B1 10/2001 Lutnaes
6,496,177 B1 * 12/2002 Burton ..... G09G 3/3611 345/101
6,535,266 B1 3/2003 Nemeth et al.
6,678,033 B1 1/2004 Brandt et al.
6,891,129 B2 5/2005 Pala et al.
7,641,386 B2 1/2010 Chen et al.
7,916,264 B2 * 3/2011 Chen ..... G02F 1/133382 250/330
7,967,446 B2 6/2011 Utsunomiya
8,488,096 B2 7/2013 Aoki
8,702,307 B2 * 4/2014 Bartholmae ..... G02F 1/133382 374/141
2004/0201564 A1 * 10/2004 Sugino ..... G09G 3/3611 345/101
2004/0207588 A1 * 10/2004 Shiomi ..... G02F 1/133382 345/87
2007/0085815 A1 * 4/2007 Oesterling ..... G09G 3/3648 345/102
2008/0100791 A1 * 5/2008 Chen ..... G02F 1/133382 349/161
2010/0061423 A1 * 3/2010 Bartholmae ..... G02F 1/133382 374/185
2016/0103358 A1 * 4/2016 Tanaka ..... G06F 3/0412 349/12

OTHER PUBLICATIONS

Singapore Written Opinion for application SG 11201702650Y, dated Jan. 10, 2018, 6 pages.

* cited by examiner

LIQUID CRYSTAL DISPLAY WITH TEMPERATURE COMPENSATION

BACKGROUND

The present disclosure relates generally to liquid crystal displays (LCDs) and, more particularly, to LCDs with temperature compensation features for use in cold temperatures such as, for example, as part of a temperature-controlled enclosure.

LCDs are commonly used in portable devices and systems that require a visual display of information. For example, LCDs may be included as part of a temperature-controlled enclosure to provide information about the temperature within the enclosure and other information that will be relevant to the user. However, the liquid crystal material used by these displays is sensitive to temperature changes as the viscosity of the liquid crystal increases at low temperatures. This results in slow response times and poor readability of the display. Currently available LCDs include those with heaters that compensate for low ambient temperatures. Because of the importance of these displays, the industry remains receptive to improvements in LCDs for use in cold temperatures.

SUMMARY OF THE INVENTION

Disclosed herein is a method of operating a liquid crystal display (LCD) that includes observing a measured temperature of an LCD panel. The measured temperature is then compared to a threshold temperature. If the measured temperature falls below the threshold temperature, it is compared to one or more set points. In response to the comparison of the measured temperature to the one or more set points, a heating panel is operated at a control rate and one or more contrast parameters of the LCD panel are controlled.

In addition to one or more of the features described above, or as an alternative, in further embodiments, the plurality of control rates may comprise controlling a pulse width modulation circuit at different duty cycle levels.

In addition to one or more of the features described above, or as an alternative, in further embodiments, the one or more contrast parameters may include one or more of potentiometer value, bias ratio, and gain value.

In addition to one or more of the features described above, or as an alternative, in further embodiments, the heating panel may be arranged within the LCD unit.

Another aspect of the disclosure provides an LCD unit with temperature compensation. The LCD unit includes a housing and an LCD panel arranged in the housing. A backlight is also arranged in the housing with a heating panel arranged between the LCD panel and the backlight. A temperature sensor is arranged at the LCD panel. A controller is also included, and is arranged to receive information from the temperature sensor. The controller is configured to control the heating panel and one or more contrast parameters of the LCD panel in response to the information received from the temperature sensor.

In addition to one or more of the features described above, or as an alternative, in further embodiments, the heating panel may be formed from indium-tin-oxide.

In addition to one or more of the features described above, or as an alternative, in further embodiments, the controller may include a PWM circuit arranged to deliver power to the heating panel at a selected duty cycle.

In addition to one or more of the features described above, or as an alternative, in further embodiments, the LCD unit may further comprise one or more spacers arranged between the LCD panel and the heating panel.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures. It is to be understood that other embodiments may be utilized and changes may be made without departing from the scope of the present disclosure. In particular, the disclosure provides various examples related to temperature-controlled enclosures, whereas the advantages of the present disclosure as applied in a related field would be apparent to one having ordinary skill in the art and are considered to be within the scope of the present invention.

Figure 1:
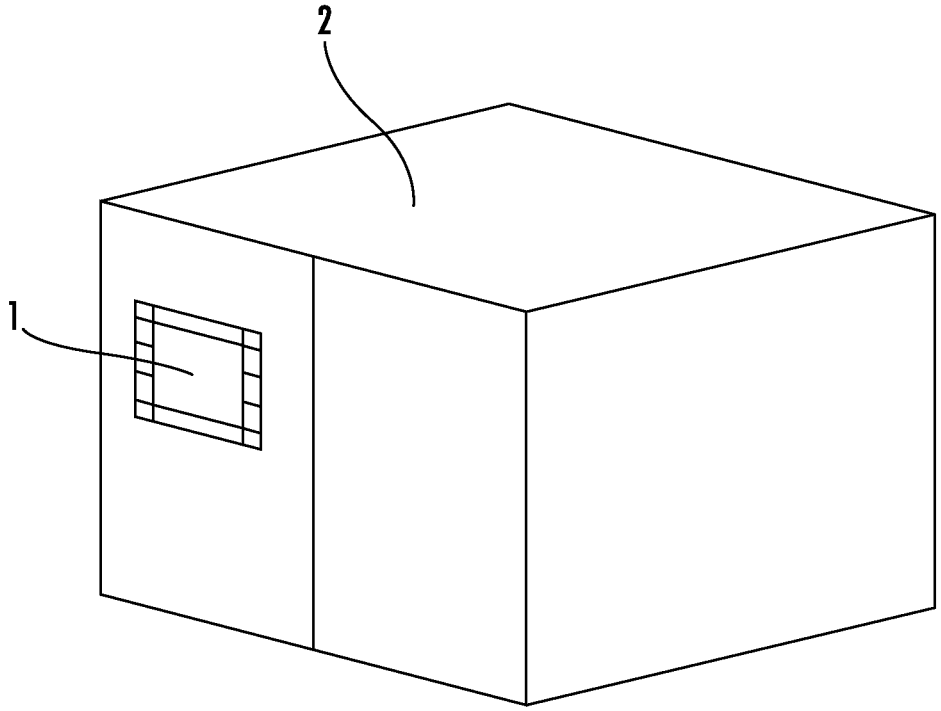
FIG. 1 is an illustration of a temperature-controlled enclosure according to one embodiment.

FIG. 1 illustrates an exemplary embodiment of present disclosure in which a liquid crystal display (LCD) unit 1 is implemented in connection with a temperature-controlled enclosure 2. The temperature compensating features of the LCD unit 1 are advantageous in compensating for extreme temperatures, (i.e., very low or very high temperatures), outside the enclosure 2. In other examples, the LCD unit 1 may be arranged within the enclosure 2, in which case the temperature compensating features mitigate the effect of low temperatures within the enclosure 2. The temperature-controlled enclosure 2 may be a portable structure or part of a larger structure. Each of these arrangements, and others that may be apparent to those in the art, are within the scope of the present disclosure.

Figure 2:
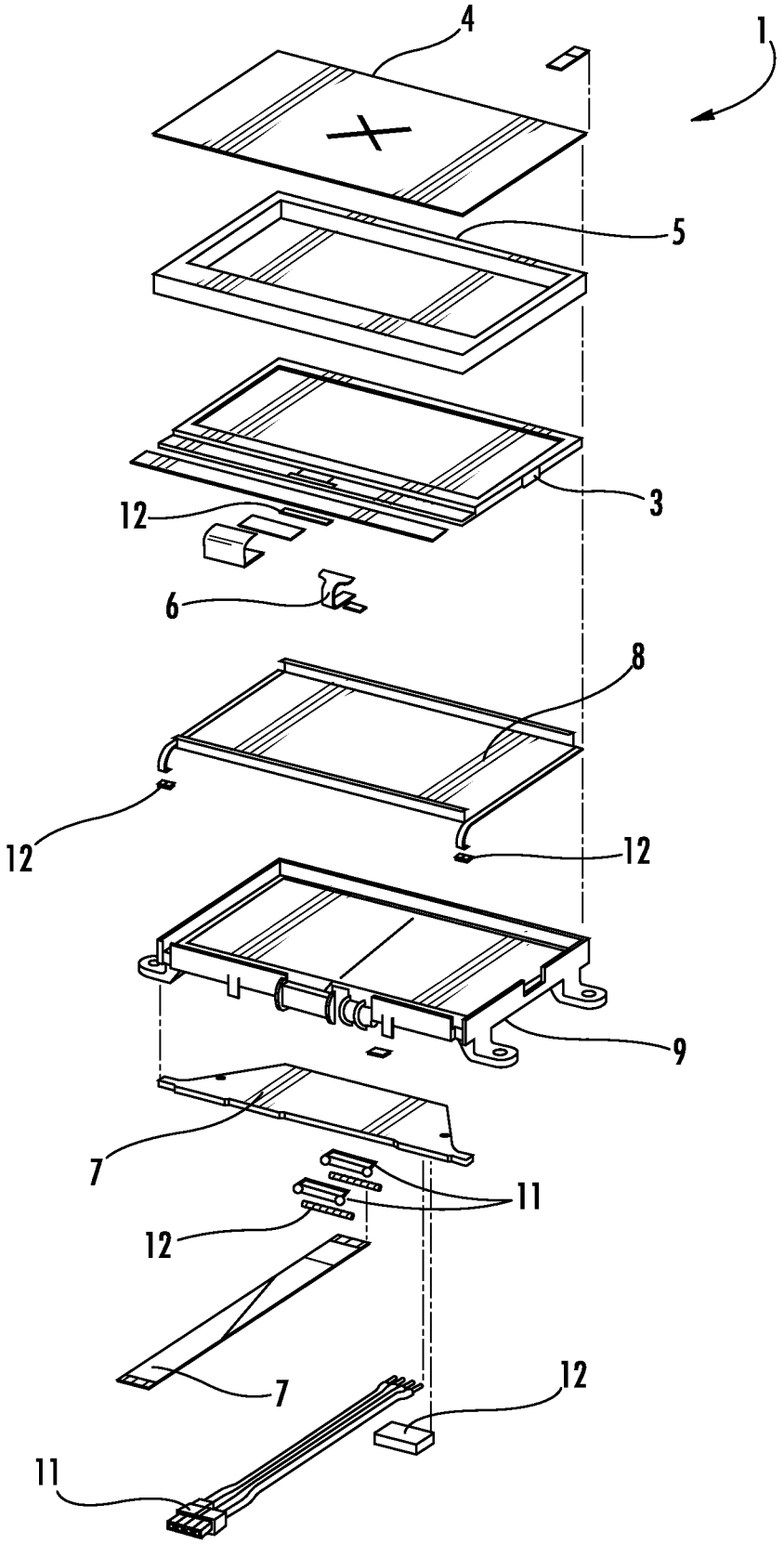
FIG. 2 is an exploded view of an LCD unit according to another embodiment.

FIG. 2 provides an exploded view of the LCD unit 1 according to one embodiment of the present disclosure. The LCD unit 1 comprises a LCD panel 3 that may be mounted beneath a protective film 4, which may be a removable film, and a housing 5. A temperature sensor 6 is mounted with the LCD panel 3 and arranged to measure the temperature of the LCD panel 3. The temperature sensor 6 is further arranged in communication with a controller 7, which may comprise a processor having a printed circuit board, a flexible printed circuit, and/or a memory unit. A heating panel 8 is arranged between the LCD panel 3 and a backlight 9. One or more spacers 10 may be arranged to form a gap between the LCD panel 3 and the heating panel 8. The controller 7 may also include one or more interfaces 11, (e.g., communications ports and/or cables), for receiving information from other sensors or for sending outputs, for example, to the LCD panel 3 and/or the heating panel 8. In addition, the LCD unit 1 includes one or more fasteners 12, such as adhesives, clamps, screws, and the like, for arranging the various elements discussed above.

The controller 7 receives information from the temperature sensor 6 and determines various steps based on that information. In some examples, the controller 7 may comprise one or more processors having one or more circuit boards. The temperature sensor 6, which may be a thermistor or the like, measures the temperature of the LCD panel 3 at any location along the front or back of the panel. For example, the temperature sensor 6 of FIG. 1 is located at the bottom-center of the LCD panel. The controller uses this information to test whether or not the measured temperature has fallen below a threshold temperature, at which point the heating panel 8 is activated. The heating panel 8 may be controlled, for example, to keep the LCD panel 3 within a temperature range that corresponds to an acceptable refresh rate.

In addition, the controller may be configured to control various aspects of the visual function of the LCD panel, such as, for example, the contrast of the display. Controlling the contrast of the display improves the visibility of the images shown on the display. The contrast control may be used in conjunction with the heating panel, which is used to maintain a high refresh rate, to improve the overall reliability of the LCD unit.

The heating panel 8 comprises a substance, which may be transparent, having a desired amount of resistance, causing the panel to give off heat. One example of a substance appropriate for an LCD heating panel 8 is indium-tin-oxide (ITO). This and other appropriate substances are well known in the art. Further, the term "heating panel" is defined herein as a heater arranged to heat the LCD panel and, therefore, may include any number of geometric arrangements not otherwise resembling a "panel."

When the measured temperature drops below the threshold temperature, power is provided to the heating panel 8 at a first controlled rate. As the measured temperature continues to drop below a set point temperature, for example a first set point temperature less than the threshold temperature but greater than a second set point temperature, power is supplied to the heating panel 8 at a second controlled rate, the second controlled rate being greater than a first controlled rate.

The amount of heat given off by the heating panel 8 may be controlled, for example, by providing power to the heating panel 8 on an intermittent basis. This can be accomplished by including a pulse width modulation (PWM) circuit in the controller 7. Thus, the first controlled rate may be achieved by modulating the PWM circuit to provide power to the heating panel 8 approximately 25% of the time; i.e. a duty cycle of 25%. The second controlled rate, for example, may provide power to the heating panel 50% of the time, and so on. The amount of power for each controlled rate may be determined based upon the specific requirements of the application, including the configuration of the heating panel 8 and the expected operating conditions.

The controller 7 further compensates for low temperatures by controlling various aspects of the contrast of the LCD panel 3. These aspects may include, for example, a potentiometer value, a bias ratio, and a gain value. As further discussed below, each of these aspects may be controlled independently according to a control scheme based upon a discrete or continuous series of set points. The controller 7 can optimize the contrast of the LCD panel 3 in both high and low temperature conditions.

Figure 3:
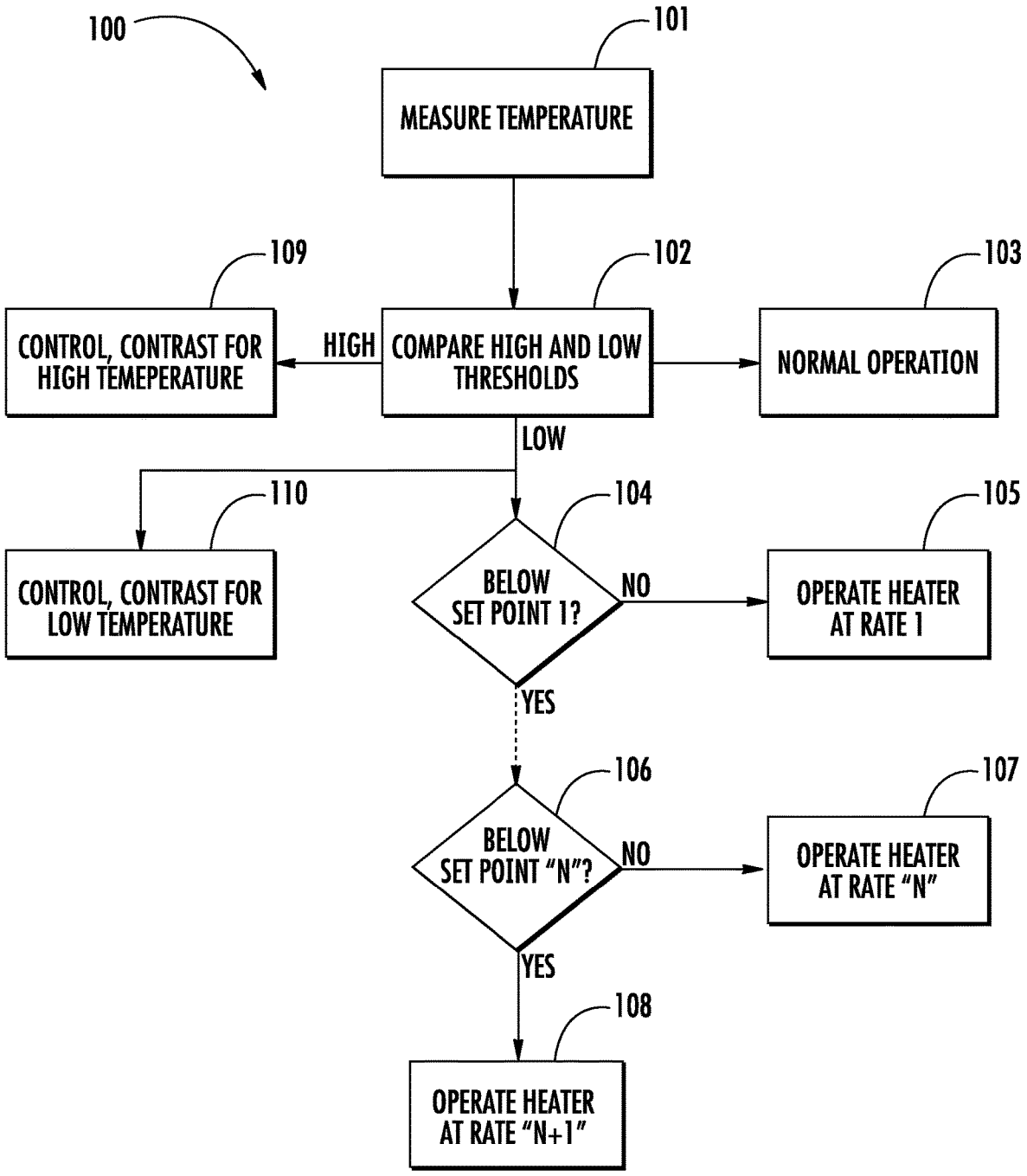
FIG. 3 is a schematic of a method for operating an LCD unit according to another embodiment.

FIG. 3 illustrates an exemplary embodiment of a method of operating an LCD panel 100 to compensate for extreme temperatures according to the present disclosure. The temperature of the LCD panel is measured and is read by the controller (step 101). The controller then compares the measured temperature with the selected high and low threshold temperatures (step 102). If the measured temperature is between the high and low threshold temperatures, the LCD continues to operate normally (step 103), i.e., without the use of the heater or automated contrast controls. Where the measured temperature falls below the threshold temperature, the measured temperature is compared to one or more set points (steps 104, 106). Set point 1 is defined as the set point that is nearest to the threshold temperature, with each successive set point decreasing in value, set point 'N' being the lowest set point.

Depending on the relationship of the measured temperature to the various set points (1 to N), the controller operates the heater at a selected control rate and controls the contrast of the LCD panel at a selected level. For example, where the measured temperature falls below the threshold temperature but does not fall below set point 1 (step 104), the heater is operated at a control rate 1 (step 105). Further, where the measured temperature falls below set point 'N−1' but does not fall below set point 'N' (step 106), the heater is operated at a control rate 'N' (step 107). If the measured temperature falls below set point 'N' (step 106), the heater may be operated at a control rate 'N+1' (step 108). The number of set points, 'N', may be as few or as many as desired for a specific application.

In further embodiments, the method may comprise controlling the contrast parameters at high temperatures where the LCD panel might otherwise appear to become dark and unreadable, as well as at low temperatures. In such cases, the unit may be configured to control the contrast when the temperature exceeds one of a number of set points, similar to the method described above.

The set points at which the operation of the heater is changed may be separate and distinct from the control scheme for altering the control of the contrast of the LCD display. When the temperature of the LCD panel exceeds the high threshold temperature value, the contrast may be controlled according to a high temperature curve (step 109), wherein given temperatures correspond to different potentiometer, bias, and gain values for optimal readability of the display. Similarly, when the temperature of the LCD panel drops below the low threshold temperature, the contrast may be controlled according to a low temperature curve (step 110).

When operating the heater, the various control rates may be achieved by any one of a number of methods known in the art. For example, in addition to the PWM scheme described above where the duty cycle is increased from one control rate to another, the control rates may be distinguished by changing the voltage or current level supplied to the heating panel. Other schemes are also possible, as known in the art, and are within the scope of this disclosure.

The contrast is controlled using one or more contrast parameters that include, for example, potentiometer value, bias ratio, and gain value. While the heater control rate will typically increase, (e.g., duty cycle of the PWM circuit), from one to another, the contrast parameters may be increased or decreased to achieve an optimum view at a particular temperature. By controlling the display contrast in this manner, the LCD will maintain maximum visibility even if the heater is not totally effective in compensating for the temperature, including high temperatures where the operation of the heater is unnecessary. For example, where the ambient temperature is low enough that the heater is effective to hold the temperature at a set point 'k', the contrast control will ensure that the LCD remains readable, even where the refresh rate is diminished by the low temperature.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc., do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A liquid crystal display (LCD) unit with temperature compensation, comprising:

a housing;

an LCD panel arranged in the housing;

a backlight for the LCD panel arranged in the housing;

a heating panel arranged between the LCD panel and the backlight;

a temperature sensor arranged at the LCD panel and configured to measure a temperature of the LCD panel; and a controller arranged to receive information from the temperature sensor, the controller being configured to compare the measured temperature to a threshold temperature, wherein when the measured temperature is below the threshold temperature the controller is further configured to compare the measured temperature to one or more setpoints and control the heating panel and one or more contrast parameters of the LCD panel in response to the comparison of the measured temperature with the one or more setpoints.

2. The LCD unit of claim 1, wherein the heating panel is formed from indium-tin-oxide.

3. The LCD unit of claim 1, wherein the controller includes a PWM circuit arranged to deliver power to the heating panel at a selected duty cycle.

4. A method of operating a liquid crystal display (LCD), comprising:

measuring a temperature of an LCD panel;

comparing the measured temperature to a threshold temperature;

when the measured temperature is below a threshold temperature, comparing the measured temperature to a plurality of set points; and controlling one or more contrast parameters of the LCD panel in response to the measured temperature; and operating a heating panel arranged within the LCD at one of a plurality of control rates in response to the comparison of the measured temperature to the plurality of set points, wherein the plurality of control rates control power supplied to the heating panel at multiple controlled rates.

5. The method of claim 4, wherein the plurality of control rates comprise controlling a pulse width modulation circuit at different duty cycle levels.

6. The method of claim 4, wherein the one or more contrast parameters include one or more of potentiometer value, bias ratio, and gain value.

7. The method of claim 4, wherein the heating panel is arranged within the LCD panel.

* * * * *